US009140260B2

(12) United States Patent
Huang et al.

(10) Patent No.: US 9,140,260 B2
(45) **Date of Patent: *Sep. 22, 2015**

(54) ROTARY LOBE BLOWER (PUMP) OR VACUUM PUMP WITH A SHUNT PULSATION TRAP

(75) Inventors: Paul Xiubao Huang, Fayetteville, GA (US); Sean William Yonkers, Peachtree City, GA (US)

(73) Assignee: HI-BAR BLOWERS, INC., Fayetteville, GA (US)

( * ) Notice: Subject to any disclaimer, the term of this patent is extended or adjusted under 35 U.S.C. 154(b) by 341 days.

This patent is subject to a terminal disclaimer.

(21) Appl. No.: 13/155,123

(22) Filed: Jun. 7, 2011

(65) Prior Publication Data

US 2011/0300014 A1 Dec. 8, 2011

Related U.S. Application Data

(60) Provisional application No. 61/352,440, filed on Jun. 8, 2010.

(51) Int. Cl.

| | |
|---|---|
| ***F03C 2/00*** | (2006.01) |
| ***F03C 4/00*** | (2006.01) |
| ***F04C 18/00*** | (2006.01) |

(Continued)

(52) U.S. Cl.

CPC ..... *F04C 18/126* (2013.01); *F04B 11/00* (2013.01); *F04B 39/0055* (2013.01); *F04B 39/0061* (2013.01); *F04C 2/16* (2013.01); *F04C 2/18* (2013.01); *F04C 18/086* (2013.01); *F04C 18/16* (2013.01); *F04C 29/0014* (2013.01); *F04C 29/0035* (2013.01); *F04C 29/04* (2013.01); *F04C 29/061* (2013.01); *F04C 29/065* (2013.01); *F04C 29/068* (2013.01); *F04C 2240/30* (2013.01)

(58) Field of Classification Search

USPC ..... 418/15, 83, 85–86, 90, 96, 180–181, 418/201.1, 201.2, 206.1–206.5; 417/312, 417/540

See application file for complete search history.

(56) References Cited

U.S. PATENT DOCUMENTS

| | | | | |
|---|---|---|---|---|
| 2,489,887 A * | 11/1949 | Houghton | ..... | 418/86 |
| 4,215,977 A | 8/1980 | Weatherston | | |

(Continued)

FOREIGN PATENT DOCUMENTS

| | | | | |
|---|---|---|---|---|
| JP | 60252117 | 12/1985 | | |
| JP | 01032085 A * | 2/1989 | ..... | 418/15 |

(Continued)

*Primary Examiner* — Theresa Trieu

(74) *Attorney, Agent, or Firm* — Gardner Groff Greenwald & Villanueva, P.C.

(57) ABSTRACT

A shunt pulsation trap for a rotary lobe blower (pump) or vacuum pump reduces pulsation and NVH, and improves efficiency, without increasing overall size of the blower or pump. A rotary lobe blower (pump) or vacuum pump has a pair of synchronized parallel multi-lobe rotors that are housed in a transfer chamber and that propel flow from a suction port to a discharge port of the transfer chamber. The shunt pulsation trap includes an inner casing as an integral part of the transfer chamber, and an outer casing oversized and surrounding the inner casing. The shunt pulsation trap houses at least one various pulsation dampening device, and includes at least one injection port (trap inlet) branching off from the transfer chamber into the pulsation trap chamber and at least one feedback port (trap outlet) communicating with the blower outlet pressure.

37 Claims, 20 Drawing Sheets

(51) Int. Cl.

| | |
|---|---|
| ***F04C 18/12*** | (2006.01) |
| ***F04C 29/04*** | (2006.01) |
| ***F04B 11/00*** | (2006.01) |
| ***F04C 18/16*** | (2006.01) |
| ***F04C 2/16*** | (2006.01) |
| ***F04C 2/18*** | (2006.01) |
| ***F04C 29/06*** | (2006.01) |
| ***F04C 29/00*** | (2006.01) |
| ***F04B 39/00*** | (2006.01) |
| ***F04C 18/08*** | (2006.01) |

(56) References Cited

U.S. PATENT DOCUMENTS

| | | | | |
|---|---|---|---|---|
| 4,558,566 | A | 12/1985 | Shirakura | |
| 4,984,974 | A | 1/1991 | Naya et al. | |
| 5,051,077 | A | 9/1991 | Yanagisawa et al. | |
| 5,218,817 | A | 6/1993 | Urata | |
| 5,370,512 | A | 12/1994 | Fujitani et al. | |
| 5,614,699 | A | 3/1997 | Yashiro et al. | |
| 5,975,035 | A | 11/1999 | McWhorter | |
| 6,331,103 | B1 * | 12/2001 | Teraoka | 418/181 |
| 6,874,486 | B2 * | 4/2005 | Prior et al. | 418/15 |
| 8,172,039 | B2 | 5/2012 | Park et al. | |
| 2002/0033302 | A1 | 3/2002 | Kaneko et al. | |
| 2006/0243520 | A1 * | 11/2006 | Hertenstein et al. | 417/312 |
| 2008/0168961 | A1 * | 7/2008 | Prior et al. | 418/206.1 |
| 2010/0269797 | A1 * | 10/2010 | Prior | 418/206.1 |
| 2012/0020824 | A1 | 1/2012 | Huang et al. | |
| 2012/0171069 | A1 | 7/2012 | Huang et al. | |
| 2012/0237378 | A1 | 9/2012 | Huang et al. | |
| 2013/0247849 | A1 | 9/2013 | Huang et al. | |

FOREIGN PATENT DOCUMENTS

| | | | | |
|---|---|---|---|---|
| JP | 03124986 A | * | 5/1991 | 418/181 |
| JP | 07332273 A | * | 12/1995 | F04C 29/04 |

* cited by examiner

Suction

Trapping&Transfer

Compression

Discharge

Dampening at outlet

FIG. 5A FIG. 5B FIG. 5C FIG. 5D
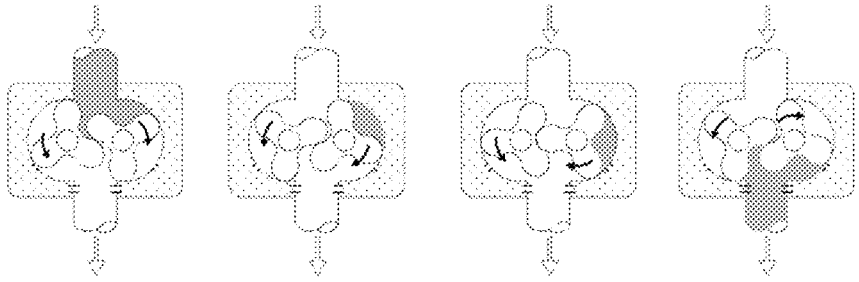
Suction Trapping & Transfer Compression & Damping Discharge
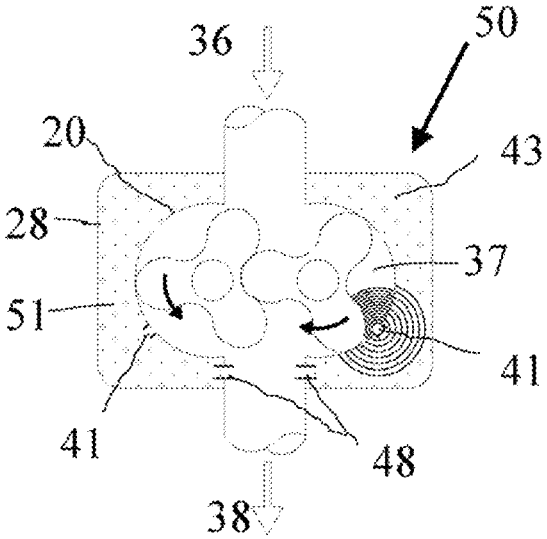
FIG. 5E One valve Two valves No valve Rotary Valve
left: open
right: close Reed Valve
left: close
right: open One valve Two valves No valve No Dampener With Dampener One valve Two valves No valve No Dampener With Dampener

ROTARY LOBE BLOWER (PUMP) OR VACUUM PUMP WITH A SHUNT PULSATION TRAP

CLAIM OF PRIORITY

This application claims priority to Provisional U.S. patent application entitled ROTARY LOBE BLOWER (PUMP) OR VACUUM PUMP WITH A SHUNT PULSATION TRAP, filed Jun. 8, 2010, having application No. 61/352,440, the disclosure of which is hereby incorporated by reference in its entirety.

BACKGROUND OF THE INVENTION

1. Field of the Invention

The present invention relates generally to the field of mechanical gaseous compressors or vacuum pumps used in industrial, automotive and municipal applications, and more particularly relates to a double rotor multi-lobe type commonly known as rotary lobe type or simply Roots type blowers or vacuum pumps, or known as Roots superchargers in internal combustion engine, and more specifically relates to a shunt pulsation trap for reducing pulsations and induced vibration, noise and harshness (NVH) from such blowers, compressors and pumps for improved efficiency and increased pressure rises.

2. Description of the Prior Art

Rotary lobe blowers or vacuum pumps with potential pressure rises for air or gases up to 30 psig (3:1 ratio) or vacuums up to 28"Hg (15:1 ratio) are widely used in industrial and municipal applications such as power source for loading and unloading bulk materials, for aeration in a waste water treatment plant, for vacuum booster evacuating a container or cleaning municipal sewer lines by vacuum suction. They are also widely used in supercharging automotive engines to boost engine power and could potentially be used for air-conditioning and refrigeration compressors.

Rotary lobe blower (that is: Roots blower or supercharger) or vacuum pump is greatly desired because of their unique compression principle: air or gas is not compressed by conventional positive displacement principle of a fixed volumetric change through the action of a piston, sliding vanes or rotary screw, but instead compressed by a series of waves or shock waves generated by a sudden opening of lobes to blower discharge pressure. The term "shockwave" denotes a physical phenomenon as also occurs in a shock tube where a diaphragm separating a region of high-pressure gas from a region of low-pressure gas inside a closed tube. As shown in FIG. 1*a*-1*b*, when the diaphragm is broken suddenly, a series of expansion waves is generated propagating from the low-pressure to the high-pressure region at the speed of sound, and simultaneously a shockwave is generated propagating from high-pressure to low-pressure region at a speed faster than the speed of sound.

Roots blower can be also seen as a fast-moving rotary valve and an effective rotary shockwave generator as long as there is a pressure difference between outlet and inlet and rotating speed is fast enough. A stronger shockwave is always associated with a higher pressure difference and faster opening. As illustrated from FIGS. 2*a* to 2*d* for a complete cycle of a classical Roots blower, by following one flow cell in a 3-lobe rotary blower, air first enters into spaces between the lobes of a pair of rotors as they are open to the inlet during their outward rotation from inlet to outlet. At lobe position shown in FIG. 2*b*, the air becomes trapped between two lobes and blower inner casing as it is moved from inlet to outlet, and still no compression and no volume change takes place. As soon as the trapped air is opened to the outlet as shown in FIG. 2*c*, a series of compression waves or shock waves is produced due to sudden opening to a higher outlet pressure, just like the diaphragm breaking open in a shock tube. The shock wave sweeps through and compresses the trapped air at a speed faster than the speed of sound, and about 5-10 times faster than the rotor tip speed. After the almost instantaneous wave compression, lobes from two rotors meet again, meshing out the compressed air to outlet chamber and return to inlet suction position to start the next cycle, as shown in FIG. 2*d*. The unique Roots wave compression principle results in a unique performance characteristic: it delivers an almost constant-flow rate at varying pressure or vacuum levels determined by the system back pressure. Moreover, within the wide pressure range, it maintains an almost constant-efficiency no matter what pressure ratio it is operating.

From the above Roots cycle analysis, it should be noted that energy transfers directly between two fluids without using mechanical components like pistons or vaned impellers. Their major benefits are their potential to generate large pressure changes in short time or distance in an efficiency equivalent to those of dry screw compressors. Two rotors of Roots blower are just used as a rotary seal and valve for moving a fixed volume of air from low pressure inlet to high pressure outlet in a fast and continuous manner. In the process, compression is accomplished by waves or shock waves generated by suddenly exposing the fast moving air to higher discharge pressure. In a sense, it is always in an under-compression mode as in the case of conventional positive displacement compressors with a pre-determined pressure ratio of one. Therefore, Roots compression possesses another unique characteristic: it maintains a good efficiency while meeting varying pressure demands. This makes rotary lobe blowers ideal for variable demand applications such as in pneumatic conveying where material clogging can be quickly cleared out or for municipal wastewater treatment aeration tanks where water levels change constantly or for automotive supercharging at different speeds and pressure boosting levels while maintaining a good efficiency throughout the process. Since the compression is achieved through faster moving waves or shock waves without hardware or the associated inertial, rotary lobe blowers can be build very small in size and simple in structure without complicated geometry or rotor contours as other varying volume types, and are capable of a long service life since there are no wearing parts involved for compression.

Despite the above mentioned generally attractive features, several challenges have impeded their extensive commercial applications of the unique Roots wave compression principle. Among them, the number one problem is the pulsation: when pressure waves or shockwaves are generated on low pressure side compressing the air inside lobe cell, a series of expansions waves are generated simultaneously on high pressure side which, together with the reflected pressure wave or shockwaves travel downstream the discharge pipe, creating huge pressure and flow fluctuations that could destroy downstream components, or generate noises as high as 140 dB for high pressure applications. Therefore, a large reactive type pulsation dampener is required at the discharge side of a rotary lobe blower to dampen the air borne pulsations, as shown in FIG. 2*e* and FIG. 3. The pulsation dampener is generally of long cylindrical shape with large cross sectional area and several chambers in series divided by baffle plates fitted with tubes for reflecting and dampening pulsations. These commercially available dampeners are very effective in pulsation attenuation but suffer additional pressure loss in the process due to high flow velocities induced by waves of large magnitude and due to periodic reversing flows colliding with the main cell flow. Moreover, they themselves generate additional vibrations and noises from their large sheet-metal surfaces typically made from steel weldment. For this reason, the whole blower package is often put into a room-like sound enclosure typically consisting of 5 sided wall panels with sound absorbent material and reflection surfaces, as shown in FIG. 4. Sound enclosure built in this fashion is generally very effective, reducing noise levels by about 20 dB, but it is expensive, bulky, especially not practical for mobile applications. For this reason, Roots compression principles are often cited with mediocre efficiency, very high pulsation and noise, large package size, all of which deter its wider use to more applications in spite of its unique merits out of wave compression.

Various attempts have been made to reduce the air borne pulsations in addition to the conventional method using a serially connected discharge dampener or silencer. One example, as disclosed in U.S. Pat. No. 4,215,977 to Weatherston, is to feed back a portion of the outlet flow through an injection port to the transfer chamber prior to discharge, in an attempt to equalize the cell pressure with the outlet hence reducing the pressure spike when the cell is suddenly exposed to the higher outlet pressure. One of the commercial applications of this technology, for example, is trademarked WhispAir manufactured by Dresser Roots. However, its effectiveness for pulsation attenuation is somehow limited, only achieving 5-10 dB reduction and a discharge dampener silencer is still needed in most of the applications. In theory, having a flow back prior to discharge could reduce pulsation amplitude by elongating releasing time to discharge pressure. But the prior art failed to recognize the existence of finite waves that travel in both directions, hence failed to attenuate them at its source: the waves are simply re-channeled and passed on to the down-stream dampener or silencer without much attenuation. Moreover, the prior art failed to address losses associated with high velocity jet flow through the injection port, compounding the pressure loss already existed from the discharge silencer.

In addition to pulsation problems associated with Roots compression, another often cited limitation is its "inherent mediocre efficiency", typically ranging from 50-60%, and its low compression ratio (typically 2.2:1, or 18 psig) it can achieve without external cooling. The two factors are somehow tied together resulted from an outlet temperature limit of about 350 F. If efficiency could be higher, say up to 80%, it would dramatically increase the pressure ratio to 3:1, or 30 psig with discharge temperature still at 350 F. It is the low efficiency that hampers Roots compression from being used more widely to higher pressure ratios and more energy sensitive applications like air-conditioning and refrigeration.

One reason for its low efficiency is from extra leakages out of thermally distorted "banana shaped cylinder". As gas goes from suction port on one side of the cylinder (inner casing) to discharge port on other side of the cylinder with a temperature rise, the discharge side (hot side) of the cylinder will typically bow towards the inlet side (cool side). However, while the blower cylinder is "banana shaped" in hot condition, the rotors remain its original straight shape and relatively uniform temperature, because they continuously experience the cyclic cool and hot air temperature during each rotation. This condition creates an uneven internal clearance at rotor tips and rotor ends between rotor and casing. Some clearance is increased from the cold state, say near discharge side, causing more internal leakage while the other clearance is decreased, posing potential rubbing and seizure failures. The later scenario often forces the design clearances to be set larger than necessary to avoid any potential contact. The result is more leakage flow. The recycled hot leakage gas raises the inlet temperature further more, further increases the discharge temperature. This becomes one of the dominant limiting factors for rotary lobe blower to reach pressure ratio like a dry sliding vane or screw type compressor. Moreover, since blower cylinder is often the structure support for bearing housings located on its sides, the precision bearing alignment in a cold state is thus shifted in a hot condition, causing potential vibrations which in turn inducing more noises.

Accordingly, it is always desirable to provide a new design and construction of a rotary lobe blower that is capable of achieving high pulsation and NVH reduction at source and improving blower efficiency without using an externally connected silencer while being kept light in mass, compact in size and suitable for high efficiency, high pressure ratio applications at the same time.

SUMMARY OF THE INVENTION

Accordingly, it is an object of the present invention to provide a rotary lobe blower with a shunt pulsation trap in parallel with the transfer chamber for trapping and attenuating pulsations close to the pulsation source.

It is a further object of the present invention to provide a rotary lobe blower with a shunt pulsation trap as an integral part of the blower casing that does not need externally connected pulsation dampeners or silencers so that it remains compact in size with smaller noise radiation surfaces and suitable for both mobile and stationary applications.

It is a further object of the present invention to provide a rotary lobe blower with a shunt pulsation trap that is capable of achieving higher adiabatic efficiency in the range equivalent or close to the conventional dry sliding vane or dry screw compressors, say up to about 80%.

It is a further object of the present invention to provide a rotary lobe blower with a shunt pulsation trap that is capable of achieving higher pressure ratio per stage in the range equivalent to the conventional dry sliding vane or dry screw compressors, say up to 3:1 ratio for pressure operation and up to 15:1 ratio for vacuum applications.

BRIEF DESCRIPTION OF THE DRAWINGS

Referring particularly to the drawings for the purpose of illustration only and not limited for its alternative uses, there is illustrated:

FIGS. 5*a* to 5*d* show the new Roots compression cycle of the present invention rotary lobe blower with a shunt pulsation trap;

FIG. 5*e* shows an exploded view of FIG. 5*c* where pressure waves and expansion waves propagate inside the compression and pulsation trap chambers;

DETAILED DESCRIPTION OF THE PREFERRED EMBODIMENT(S)

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

It should also be pointed out that though drawing illustrations and description are devoted to a straight 3-lobe rotary air blower in the present invention, the principle can be applied to other types of rotary blowers with different numbers of lobes such as two-lobed, four-lobed or five-lobed, etc. Moreover, lobes can be either straight or twisted in its axial direction as long as both rotors have the same number of lobes. The principle can also be applied to other gases or liquid media, such as lobe or gear pumps are variations of Roots type blowers for liquid and the later uses involute lobe shape to allow the lobes to function as gears with rolling interfacial contact. In addition, lobe type expanders are the above variations too except being used to generate shaft power from media pressure drop.

Figure 1A:
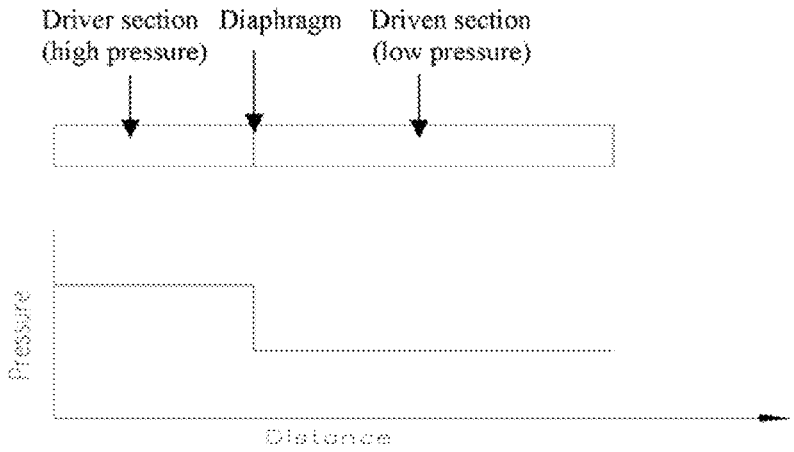
FIGS. 1*a* and 1*b* show a shock tube device with the pressure, wave distribution before and after diaphragm is broken.
Figure 1B:
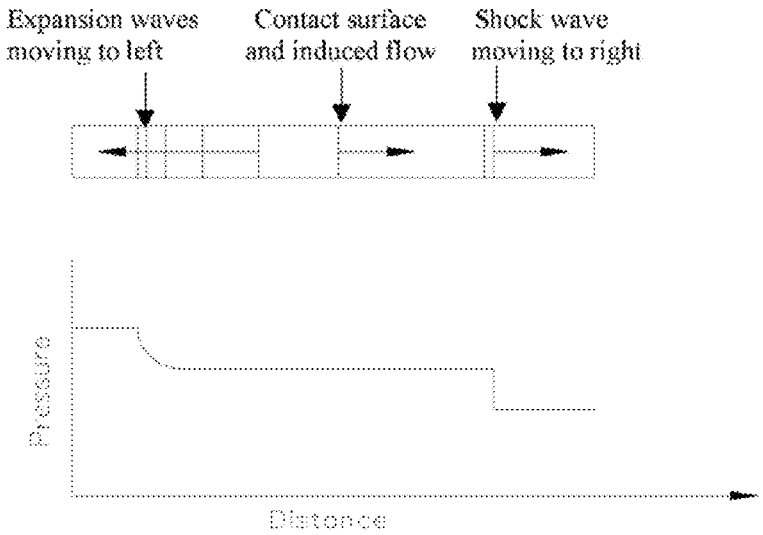
Figure 2A:
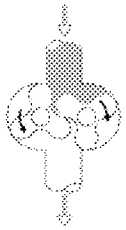
FIG. 2A Prior Art
FIGS. 2*a* to 2*e* (PRIOR ART) show the compression cycle of a conventional rotary lobe blower with a silencer in series with discharge port.
Figure 2B:
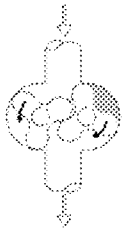
FIG. 2B Prior Art
Figure 2C:
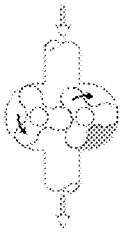
FIG. 2C Prior Art
Figure 2D:
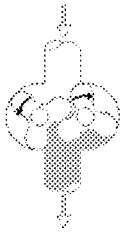
FIG. 2D Prior Art
Figure 2E:
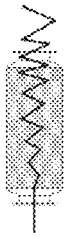
FIG. 2E Prior Art
Figure 3:
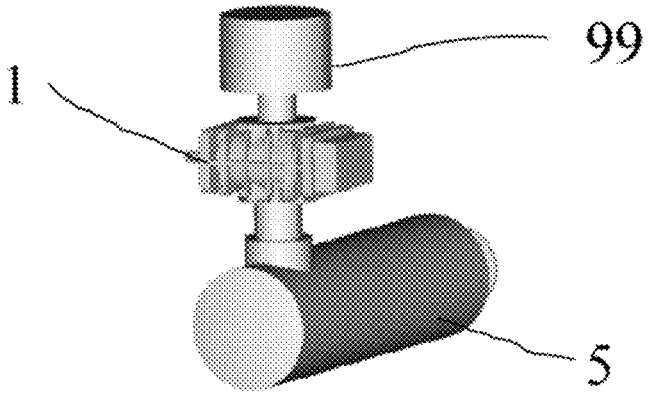
FIG. 3 (Prior Art)
FIG. 3 (PRIOR ART) shows a perspective view of a conventional rotary lobe blower with an inlet filter and outlet silencer in a typical application package.
Figure 4:
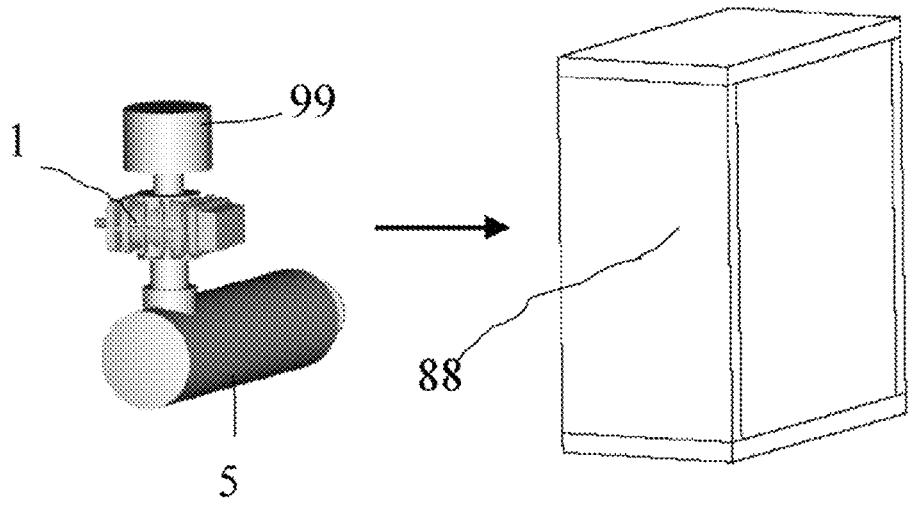
FIG. 4 (Prior Art)
FIG. 4 (PRIOR ART) shows a perspective view of a conventional rotary lobe blower with an inlet filter and outlet silencer inside a sound enclosure.

As a brief introduction to the principle of the present invention, FIGS. 5*a* to 5*d* show again a complete cycle of Roots compression for a 3-lobe rotary blower but with an addition of a shunt (parallel) pulsation trap of the present invention. In broad terms, pulsation traps are used to trap AND attenuate gas pulsations in order to reduce air borne pulsations discharged to atmosphere or downstream applications. Discharge dampener type shown in FIG. 2*e* and FIG. 3 is the most common used pulsation trap (conventional type) which is connected in series with the transfer (compression) chamber and through which both fluid flow and pulsation waves pass. The shunt pulsation trap is another type of pulsation trap but connected in parallel with the transfer (compression) chamber. As illustrated in FIGS. 5*a* and 5*b*, the phases of flow suction and flow trapping are still the same as those shown in FIGS. 2*a* and 2*b*. But during compression phase, instead of waiting for opening at the outlet as conventional rotary lobe blowers, the trapped flow cell is pre-opened to an injection port (or trap inlet) that is positioned at least one lobe span away from the blower suction port (For a 3-lobe blower, it is 120 degrees and for 2-lobe, 180 degrees). The injection port is branched off from the transfer chamber into the pulsation trap as a parallel chamber that is also communicating with the blower outlet through a feedback port (trap outlet). Between injection and feedback port and within pulsation trap, there is a pulsation dampening device (which can additionally or alternatively operate to provide pulsation energy recovery or containment or both), to control pulsation energy before it travels downstream or released to atmosphere. As shown in FIG. 5*c* or 5*e*, a series of waves is produced as soon as the trapped cell is opened to the trap inlet due to a pressure difference between the pulsation trap (relates to outlet pressure) and trapped cell (relates to inlet pressure). The generated pressure waves or shockwaves travel to low pressure cell compressing the air inside, and at the same time, the simultaneously generated expansion waves on the high pressure side, together with part of reflected shockwaves, are entering the pulsation trap, and therein are being attenuated. Because waves travel at a speed about 5-10 times faster than the rotor tip speed, the attenuation is well under way before the lobe tip reaches the outlet, hence discharging a pulsation-treated air. If the shunt chamber (pulsation trap) energy dissipating volume and damping coefficients are specifically designed for achieving optimum attenuation, the pulsation-treated air can be almost pulse free. Then the lobes of two rotors will meet again, meshing out the pulse-free compressed air to outlet and return to inlet suction position to start next cycle, as shown in FIG. 5*d*.

The principal difference with the conventional rotary blower is in the compression and dampening phase: instead of waiting and delaying the compression and attenuation action until the lobe tip reaches the outlet by using a serially-connected dampener silencer, the shunt pulsation trap would start compression and induce pulsations into the trap as soon as the trapped cell is sealed from the inlet. It then dampens the pulsations within the trap simultaneously as the cell flow is being compressed before reaching the outlet. In this process, the flow cell being compressed and pulsations being attenuated are in parallel with each other instead of in series as in a conventional rotary blower.

There are several advantages associated with the parallel pulsation trap compared with the serially connected dampener silencer. First of all, pulsating wave is separated from the main cell flow so that an effective attenuation will not affect the main flow cell, resulting in both higher compression efficiency and attenuation efficiency. In a traditional serially connected silencer, both pulsating waves and fluid flow move together through the dampening elements inside the silencer where a better attenuation always comes at the expense of a higher pressure loss. So a compromise is often made in order to reduce losses by sacrificing the magnitude of pulsation dampening or have to use a very large volume silencer in a serial setup.

Secondly, the parallel pulsation trap attenuates pulsation much closer to the pulsation source than a serial one and is capable of using a more effective pulsation dampening means without affecting main flow efficiency. It can be built as an integral part and conforming shape of the blower casing with a much smaller size and footprint, less weight. By replacing the traditional serially connected silencer with an integral paralleled pulsation trap, it will be compact in size which also reduces noise radiation surfaces and is more suitable for mobile applications.

Moreover, the pulsation trap is so constructed that its inner casing is an integral part of the outer casing of the transfer chamber, and the outer casing are oversized surrounding the inner casing, resulting in a double-walled structure enclosing and concealing the noise source deeply inside the core. The casings could be made of cast iron that would be more waves absorptive, thicker and more rigid than a conventional sheet-metal silencer casing, hence less prone to noise radiation. In addition, the outer casing can be provided with an outer noise abatement jacket for further noise reduction.

With an integral pulsation trap, the blower outer casing would be more structurally rigid and resistant to stress or thermal related deformations. At the same time, the double-wall casing tends to have a more uniform temperature distribution inside the pulsation trap so that the traditional "banana shaped casing distortion" would be kept to minimum, thus reducing internal clearances and leakages, resulting in a higher blower efficiency.

With a better control over pulsation and pressure losses, the blower with the shunt pulsation trap is capable of achieving higher pressure ratio in a range equivalent to the conventional dry sliding vane or dry screw compressors with pressure rises, say up to 30 psig.

It should be pointed out that though drawing illustrations and description are devoted to a rotary blower with a single stage pulsation trap in the present invention, the principle can be applied to 2 or more stage cases corresponding to rotary blowers with more lobes such as four-lobed or five-lobed, etc. In the case of a two stage pulsation trap corresponding to a four-lobed blower, two traps are connected in series in such a way that the first trap inlet is at least one lobe span away from the blower inlet and the first trap outlet communicates with the second trap pressure, and the second trap inlet is at least one lobe span away from the first trap inlet and the second trap outlet communicates with the blower outlet pressure in order to achieve multistage compression and dampening. In other embodiments, at least two of the pulsation traps are connected in parallel, with the first trap inlet located at least one lobe span away in the flow direction from the suction port and the first trap outlet communicating with the atmosphere, and the second trap inlet located at least one lobe span away in the flow direction from the first trap inlet and the second trap outlet communicating with the atmosphere in order to achieve multistage compression and dampening.

Figure 6:
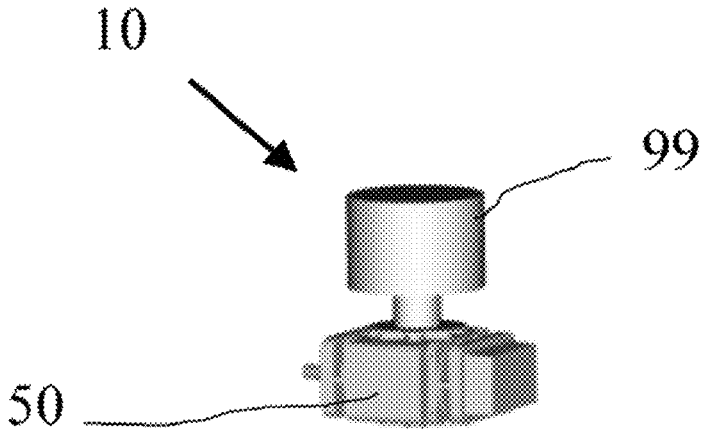
FIG. 6 shows a perspective view of the present invention rotary lobe blower with a shunt pulsation trap and an inlet filter in a typical application package.
Figure 7A:
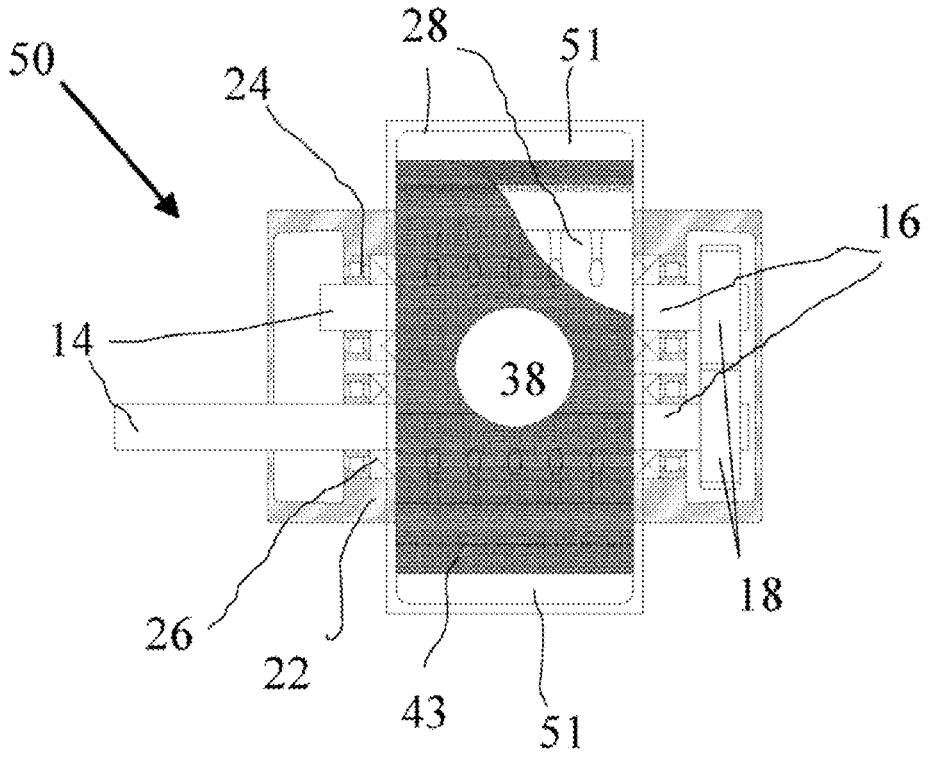
FIGS. 7*a* and 7*b* show a cross-sectional front and side view of a preferred embodiment of the shunt pulsation trap.
Figure 7B:
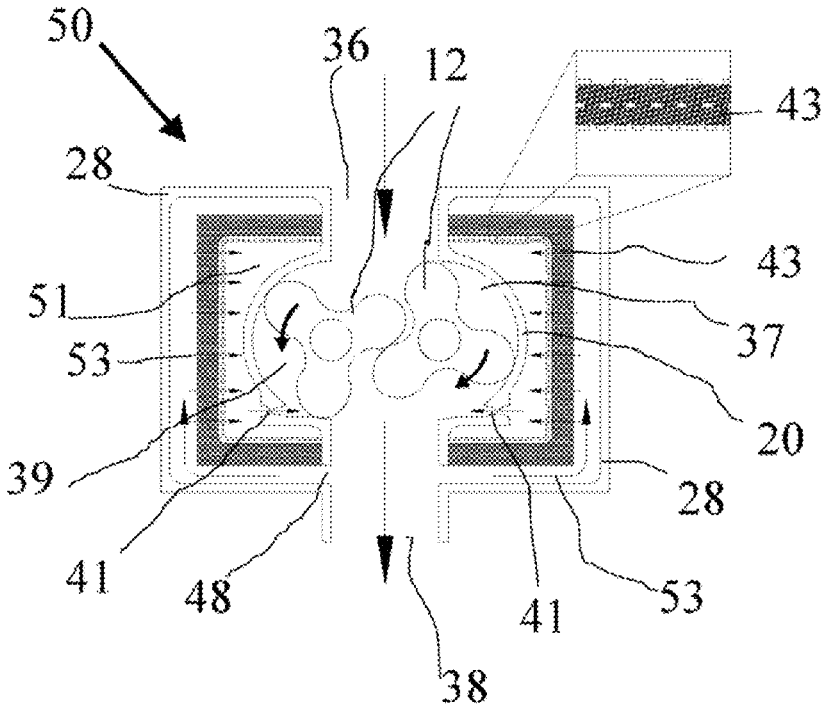

Referring to FIGS. 6 to 7*b*, there is shown a typical arrangement of a preferred embodiment of a rotary blower 10 with a shunt pulsation trap apparatus 50. Typically, the rotary blower 10 has two parallel rotors 12 mounted on rotor shafts 14 and 16 respectively, where rotor shaft 14 driven by an external rotational driving mechanism (not shown) and through a set of timing gears 18 drives the rotors 12 in synchronization without touching each other for propelling flow from a suction port 36 connected with an inlet filter 99 to a discharge port 38 of the transfer chamber 37 of the blower 10. The rotors 12 can include an inter-lobe profile seal or an end seal. The rotary blower 10 also has an inner casing 20 as an integral part of the transfer chamber 37, wherein the rotor shafts 14 and 16 are mounted on an internal bearing support structure 22 with bearings 24 and seals 26. The casing structure further includes an outer casing 28 with a space maintained between the inner casing 20 and the outer casing 28 forming the pulsation trap chamber 51.

As an important novel and unique feature of the present invention, a shunt pulsation trap apparatus 50 is conformingly surrounding the rotary blower 10 of the present invention, and its cross-section is illustrated in FIG. 5*e* and FIG. 7*b*. In the embodiment illustrated, the shunt pulsation trap apparatus 50 is further comprised of an injection port (trap inlet) 41 branching off from the transfer chamber 37 into the pulsation trap chamber 51 and a feedback port (trap outlet) 48 communicating with the blower outlet 38, and therein is housed a pulsation dampening device (e.g., one or more perforated plates and/or acoustic absorption materials, such as the FIG. 7*b* depicted three perforated plates, with each having a slightly different hole size, and with acoustic absorption material between the plates) 43. The perforated plate 43 is located within the pulsation trap chamber 51 between the trap inlet 41 and the trap outlet 48. As lobe tip passes over the trap inlet 41 as shown for the right rotor in FIG. 5*e*, a series of pressure waves are generated at trap inlet 41 going into the transfer chamber 37 inducing a feedback flow 53. Simultaneously a series of expansion waves are generated at trap inlet 41, but travelling in a direction opposite to the feedback flow, that is: from trap inlet 41, going through dampener 43 before reaching trap outlet 48 and blower outlet 38. In FIG. 7*b*, the large arrow shows the direction of rotation and internal main flow cells as propelled by the rotors 12 from the suction port 36 to the discharge port 38 of the blower 10, while feedback flow 53 as indicated by the small arrows goes from the feedback port (trap outlet) 48 into the pulsation trap chamber 51, then going through the dampener 43 and converging to the injection port (trap inlet) 41 and releasing into the transfer chamber 37 when lobe tip is opened up and becoming the compression chamber 39. The multi-lobe rotors 12 define lobe spans, and the trap inlet 41 is positioned at least one lobe span away from the suction port 36 ("one lobe span from suction port 36" means that the incoming flow being compressed is just isolated from or stops communicating with the suction port 36).

When a rotary blower 10 is equipped with the shunt pulsation trap apparatus 50 of the present invention, there exist both a reduction in the pulsation transmitted from rotary blower to blower downstream flow as well as an improvement in internal flow field (hence its adiabatic efficiency) and leakage control so that it is compactly suitable for mobile and stationary applications, and efficiently suitable for higher pressure applications like conventional dry sliding vane or dry screw compressors.

The theory of operation underlying the shunt pulsation trap apparatus 50 of the present invention is as follows. As illustrated in FIG. 5*a* to FIG. 5*e* and also refer to FIG. 7*b*, phases of flow suction and flow transfer are still the same as those shown in FIGS. 2*a* and 2*b* of a conventional rotary lobe blower. But during compression phase, instead of waiting to be opened to blower outlet 38 as the conventional rotary lobe blower does, the trapped flow cell inside the transfer chamber 37 is pre-opened to the injection port (or trap inlet) 41 that is at least one lobe span away from the suction port 36 opening (For a 3-lobe blower, it is 120 degrees). As shown in FIG. 5*e*, a series of pressure waves or shock waves are produced due to a pressure difference between the pulsation trap chamber 51 (close to outlet pressure) and transfer chamber 37 (close to inlet pressure). The pressure waves traveling into the transfer chamber 37 (now becoming compression chamber 39) compress the trapped air inside, but at the same time, the accompanying expansion waves and a small portion of reflected pressure waves or shock waves enter the pulsation trap chamber 51, and therein are being attenuated by dampening device 43. Because waves travel at a speed about 5-10 times faster than the rotor 12 tip speed, the attenuation is well under way even before the lobe tip reaches the blower outlet opening 38, hence discharging a pulsation-free or pulsation-reduced air. If pulsation trap energy dissipating capacitance and resistance are specifically selected for achieving optimum attenuation, the pulsation reduction can be quite significant so that traditional externally connected outlet pulsation dampener or silencer is not needed anymore thus saving space and weight and suitable for mobile applications.

Figure 8:
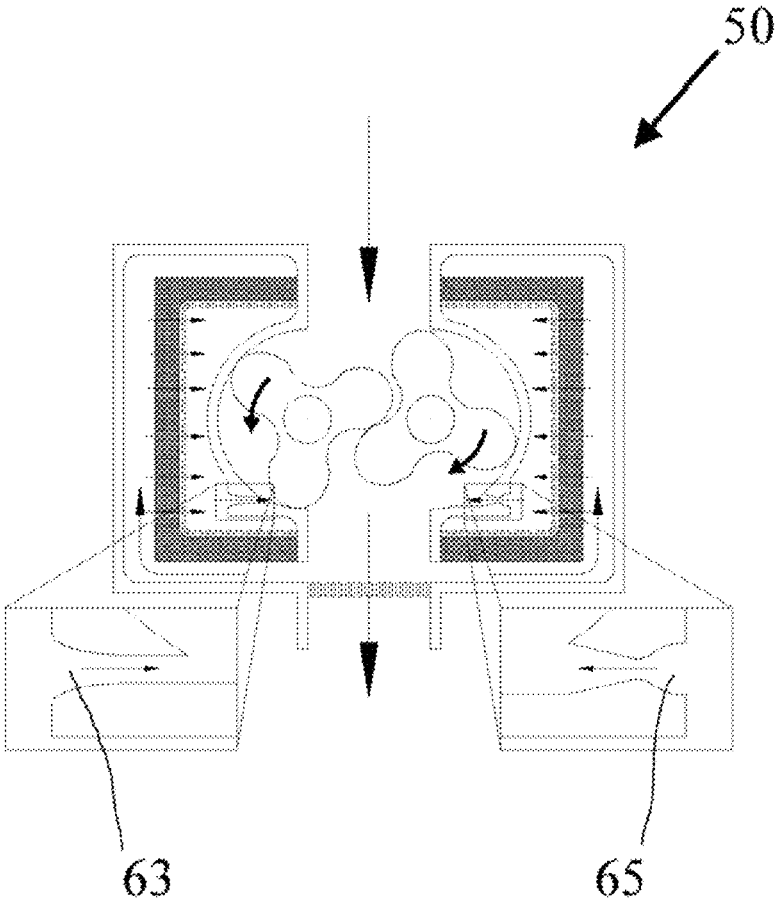
FIG. 8 is a cross-sectional view of different shapes of injection port nozzle of the shunt pulsation trap.

Moreover, the hot feedback flow 53 sandwiched between the cored and integrated inner casing 20 and outer casing 28 acts like a water jacket of a piston cylinder in an internal combustion engine, tending to equalize temperature difference between the cool suction port 36 and hot discharge port 38. This would lead to less "banana shaped" thermal distortion of the inner casing 20, which in turn would decrease the internal end clearance and tip clearance. In addition, by getting rid of the serially connected silencer dampening the main discharge flow, the associated dampening losses are eliminated for the main cell flow. At the trap inlet 41, the induced injection flow could be "choked" as pressure ratio across reaches 1.89 seriously limiting flow capacity and creating losses. So using a converging cross-sectional-shaped nozzle 63 or a de Laval converging-diverging cross-sectional-shaped nozzle 65, as shown in FIG. 8, would improve injection flow rate and efficiency compared to a traditional orifice so that blower overall adiabatic efficiency is greatly increased, hence suitable for higher pressure applications like conventional dry sliding vane or dry screw compressors.

Figure 9A:
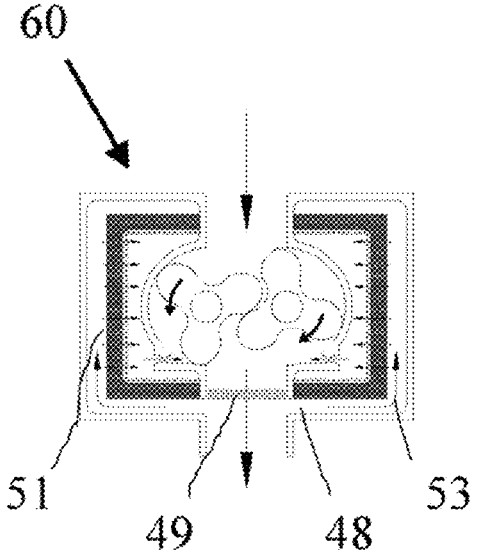
FIGS. 9*a* and 9*b* show a cross-sectional side view of an alternative embodiment of the shunt pulsation trap with an additional wave reflector either before or after the trap exit.
Figure 9B:
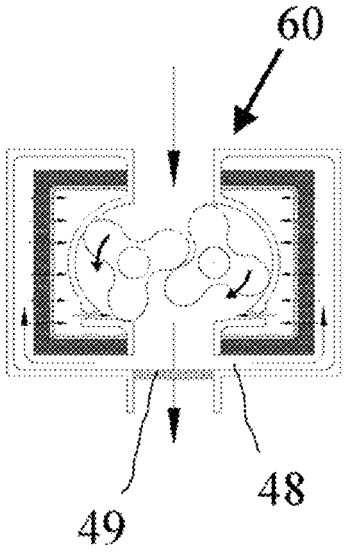
Figure 10A:
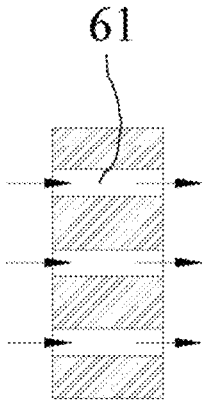
FIGS. 10*a* to 10*c* are cross-sectional views of different shapes of wave reflector of the shunt pulsation trap.
Figure 10B:
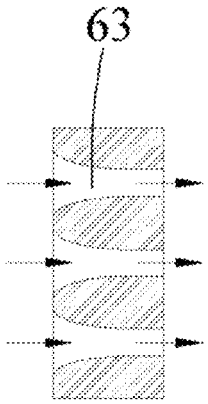
Figure 10C:
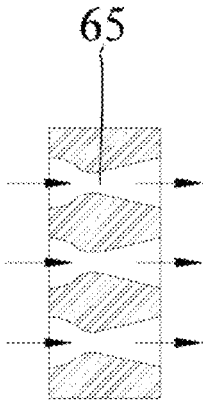

FIG. 9 shows a typical arrangement of an alternative embodiment of the rotary blower 10 with a shunt pulsation trap apparatus 60. In this embodiment, a perforated plate 49 acting as a wave reflector is added to the pulsation tarp 60. FIG. 9*a* and FIG. 9*b* show wave reflector 49 is located before or after feedback port (trap exit) 48 respectively. In theory, a wave reflector is a device that would reflect waves while let fluid go through without too much losses. In this embodiment, the leftover pulsations either from the compression chamber 39 or coming out of pulsation trap outlet 48 or both could be further contained and prevented from traveling downstream causing vibrations and noises, thus capable of achieving more reductions in pulsation and noise but with additional cost of the perforated plate and some associated losses. With the feedback flow 53 going through the pulsation trap 51, the main discharge cell flow is unidirectional through the discharge wave reflector 49 as shown in FIG. 9*a* without flow reversing losses and the associated dampening losses are greatly reduced too by using perforated holes with shape of a converging cross-sectional-shaped flow nozzle 63 or de Laval converging-diverging cross-sectional-shaped nozzle 65 as shown in FIGS. 10*a-c*, thus improving flow efficiency at discharge compared to a traditional rotary lobe blower. In other embodiments, at least one perforated plate (wave reflector) is located at the suction port, or at both the suction port and the discharge port.

Figure 11:
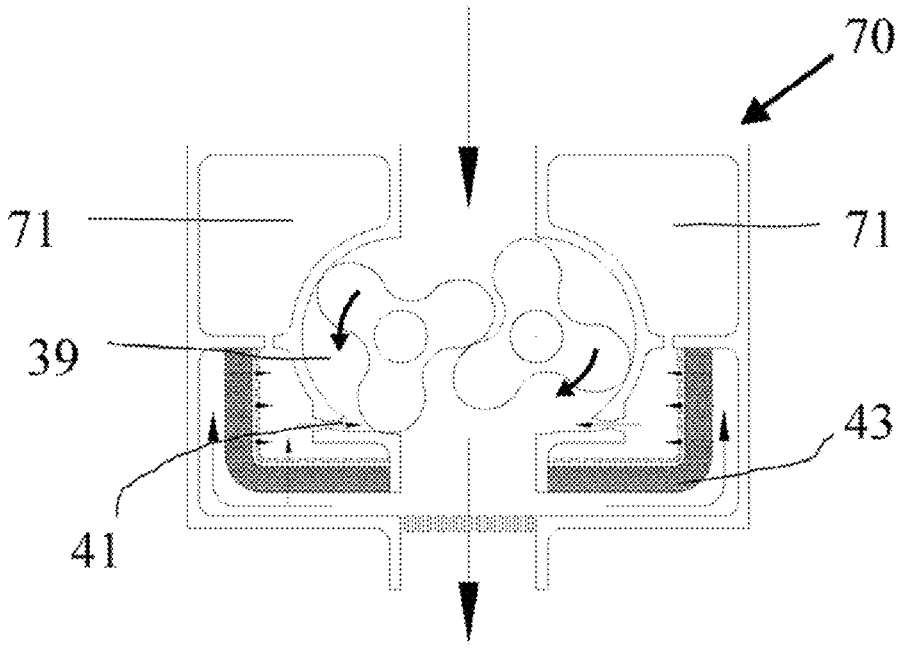
FIG. 11 is a cross-sectional side view of another alternative embodiment of the shunt pulsation trap with a resonator.

FIG. 11 shows a typical arrangement of yet another alternative embodiment of the rotary blower 10 with a shunt pulsation trap apparatus 70. In this embodiment, Helmholtz resonators 71 are used as an alternative pulsation dampening device supplementing the pulsation dampening device 43 of the pulsation trap 70. In theory, Helmholtz resonators could reduce undesirable low frequency pulsations by building a resonator tuned to the problem frequency thereby eliminating it. Since the rotary lobe blower generates a specific single frequency pulsation when running at fixed speed and a Helmholtz resonator could be tuned to that specific frequency for elimination. In this embodiment, the pulsations generated at trap inlet 41 would be treated by Helmholtz resonator 71 located close to trap inlet 41 and in parallel with dampener 43. It could also be used alone or in multiple numbers. In other embodiments, the pulsation dampening device includes at least one Helmholtz resonator in parallel with at least one synchronized valve that is closed and opened as each lobe passes the trap inlet.

Figure 12A:
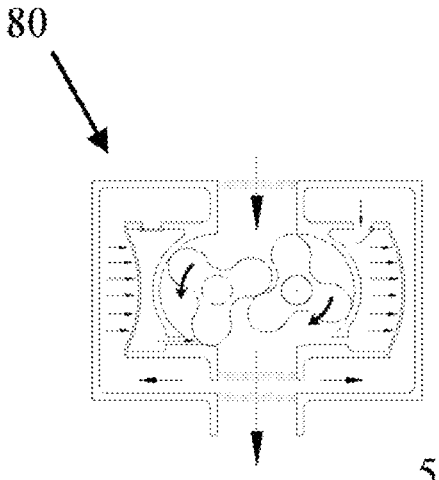
FIGS. 12*a* to 12*c* show cross-sectional side views of another alternative embodiment of the shunt pulsation trap with a diaphragm as a dampener and pump.

FIGS. 12*a*-15*c* show some typical arrangements of yet other alternative embodiments of the rotary blower 10 with a shunt pulsation trap apparatus 80. In these embodiments, a diaphragm or a piston 81 is used as an alternative pulsation dampening device for the pulsation trap 80 to additionally provide for energy recovery (pumping). FIGS. 12*a-c* show embodiments in which the dampener is a diaphragm 81. FIG. 12*a* shows a one-valve configuration, FIG. 12*b* a two-valve, and FIG. 12*c* a configuration with a dampener in place of the valve. In FIGS. 12*a-c*, the left rotor shows a charging (dampening) phase with only the trap inlet 41 and valve 82 open to the transfer chamber 37 while the trap outlet 48 and valve 83 are closed. In the same way, the right rotor shows a discharging (pumping) phase with the trap inlet 41 and valve 82 closed to the transfer chamber 37 while the trap outlet 48 and valve 83 are open. The valves 82/83 used could be any types that are capable of being controlled and timed in the fashion as described above, and one example is given in FIGS. 13*a-b* for a rotary valve. In operation, as an example shown in FIG. 12*b*, a series of waves are generated as soon as the lobe tip pass over the pulsation trap inlet 41 during charging phase. The pressure waves would travel into the transfer chamber 37 while the accompanying expansion waves enter the pulsation trap chamber 51 in opposite direction. Because of the pressure difference between the pulsation trap chamber 51 (close to outlet pressure) and transfer chamber 37 (close to inlet pressure), the diaphragm 81 would be pulled towards the trap inlet 41 by the pressure difference hence absorbing the pulsation energy and storing it with the deformed diaphragm 81 (charged). At this time, the valve 83 located at the trap outlet 48 is closed, effectively sealing the waves within the pulsation trap chamber 51. As the rotor moves further and pressure difference is diminishing, the diaphragm 81 would be pulled back by the stored spring energy which then pumps air in from the now opened valve 83, building up the pressure again in the pulsation trap chamber 51 while trap inlet valve 82 is kept closed at this time. By alternatively open and close valves 82 and 83 in a synchronized way timed with the lobe and diaphragm positions, the pulsation energy could be effectively absorbed and re-used to keep the cycle going while the waves within the trap is kept confined, resulting in a pulse-free air with minimal energy losses. In other embodiments, at least one such controlled valve is located on a perforated plate dampener.

Figure 12B:
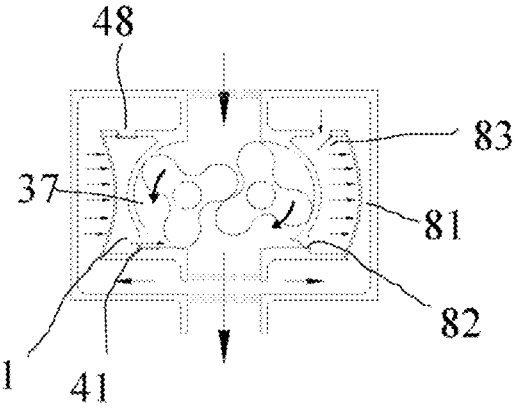
Figure 12C:
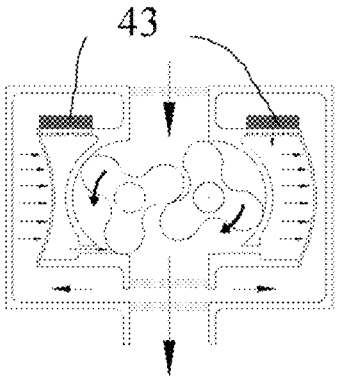
Figure 13A:
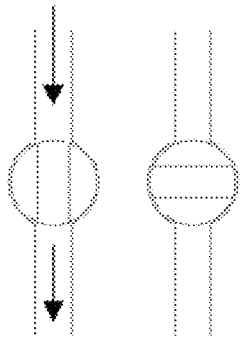
FIGS. 13*a* and 13*b* show cross-sectional views of a rotary valve and a reed valve in open and close positions.
Figure 13B:
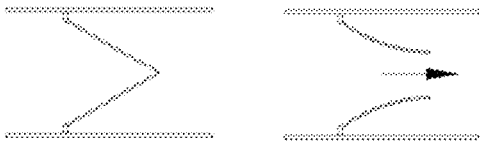
Figure 14A:
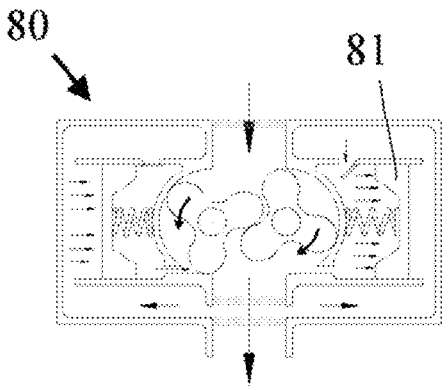
FIGS. 14*a* to 14*c* show cross-sectional side views of yet another alternative embodiment of the shunt pulsation trap with a piston as a dampener and pump.
Figure 14B:
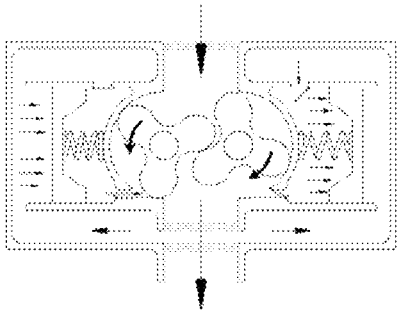
Figure 14C:
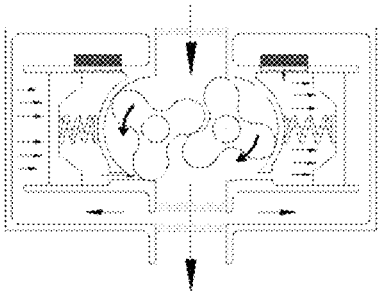

FIGS. 14*a-c* show embodiments that are similar to those of FIG. 12*a-c* except using a piston 81 instead of a diaphragm.

Figure 15A:
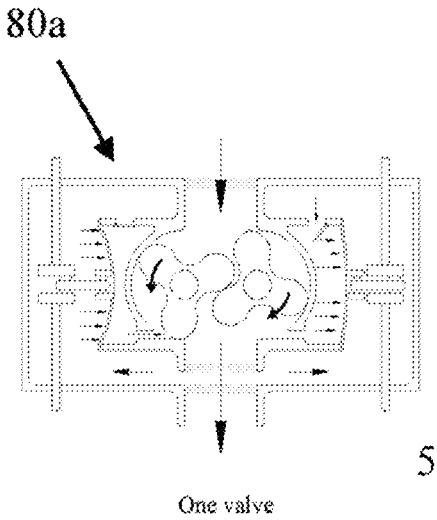
FIGS. 15*a* to 15*c* show cross-sectional side views of yet another alternative embodiment of the shunt pulsation trap with a diaphragm used as a dampener pump to drive an external load.
Figure 15B:
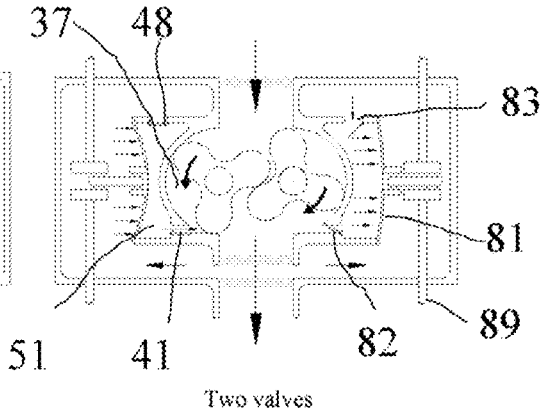
Figure 15C:
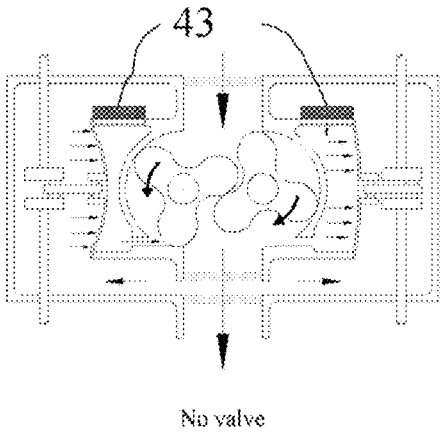

FIGS. 15 *a-c* show a typical arrangement of yet another alternative embodiment of the rotary blower 10 with a shunt pulsation trap apparatus 80*a*. In this embodiment, the diaphragm or a piston 81*a* is used as an alternative pulsation dampening device for the pulsation trap 80*a* to additionally provide for energy recovery (pumping). In this embodiment as shown in FIG. 15*b*, the difference with embodiment shown in FIGS. 12*a-c* and 14*a-c* is that all or part of the pulsation energy stored is used to drive an external load 89, say a cooling fan.

Figures 16A, 16B:
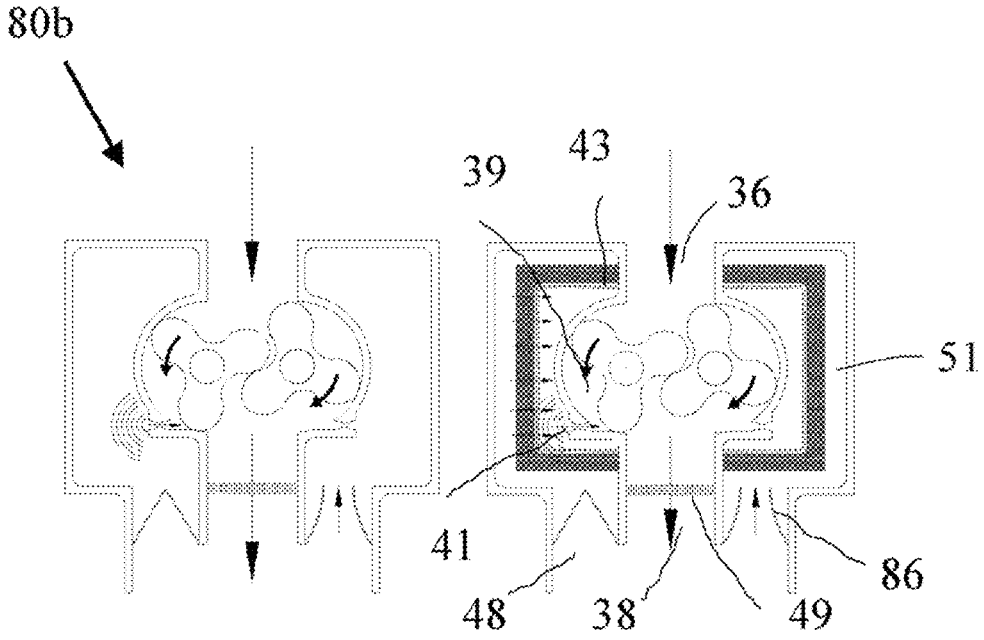
FIGS. 16*a* and 16*b* show cross-sectional side views of yet another alternative embodiment of the shunt pulsation trap with a valve at trap outlet.

FIGS. 16*a-b* show a typical arrangement of yet another alternative embodiment of the rotary blower 10 with a shunt pulsation trap apparatus 80*b*. In this embodiment, a control valve 86 is used as pulsation dampening device for the pulsation trap 80*b*, one on each side, to additionally provide for pulsation containment. FIG. 16*a* shows a valve only configuration, and FIG. 16*b* a configuration with a dampener between trap inlet and the valve. The principle of the operation is taking advantages of the opposite travelling direction of wave and flow inside the pulsation trap. By using a directional (i.e., one-way) controlled valve (e.g., a reed valve or other one-way valve), it would only allow flow in while keeping the waves from going out of the trap in a timed fashion. In FIG. 16, the left rotor shows the wave containment phase with the trap inlet 41 open to the compression chamber 39 while the trap outlet 48 is closed by valve 86. In the same way, the right rotor shows a flow in phase when the compression is finished and the trap outlet 48 is opened through valve 86. The valve 86 used could be any types that are capable of being flow controlled like a one-way reed valve or timed with lobe rotation in a fashion as described above, and one example is given in FIG. 13 for a rotary valve. In operation, as an example shown in FIG. 16*b*, a series of waves are generated as soon as the lobe tip pass over the pulsation trap inlet 41 during isolation phase. The pressure waves would travel into the compression chamber 39 while the accompanying expansion waves enter the pulsation trap chamber 51 in opposite direction. At this time, the valve 86 located at the trap outlet 48 is closed, effectively sealing the waves within the pulsation trap chamber 51 where it is being dampened by an optional dampener 43 inside. As the rotor moves further and pressure difference is diminishing, the valve 86 is opened allowing air in and building up pressure again in the pulsation trap chamber 51. By alternatively open and close valve 86 in a synchronized way timed with the lobe positions, the waves and pulsation energy could be effectively contained within the trap, resulting in a pulse-free air to the outlet. In other embodiment, the controlled valve is a rotary valve.

Figure 17:
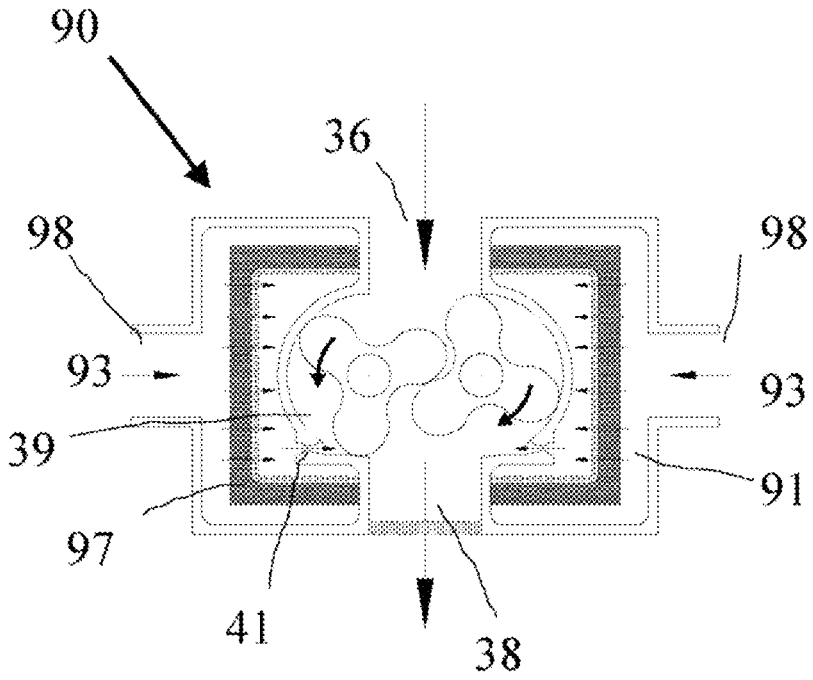
FIG. 17 is a cross-sectional side view of another alternative embodiment of the shunt pulsation trap with the pulsation trap outlet (feedback port) open to atmosphere.

FIG. 17 shows a typical arrangement of yet another alternative embodiment of the rotary blower 10 with a shunt pulsation trap apparatus 90. In this embodiment, the pulsation trap outlet is open to atmosphere instead of the blower discharge port 38. In application, a rotary lobe blower could be either used in pressure-producing-blower-mode when its inlet is open to atmosphere and its outlet is connected to the application or in a vacuum-producing-exhauster-mode when its inlet is connected to the application while its outlet is open to atmosphere. In this embodiment, the feedback flow 93 as indicated by small arrows goes from a side port 98 open to atmosphere directly into the pulsation trap chamber 91, then going through the dampener 97 and converging to the injection port (trap inlet) 41 and releasing into the compression chamber 39. In this embodiment, the feedback flow temperature is atmospheric, much cooler than feedback flow coming from blower outlet 38. This additional cooling capacity results in a much higher pressure ratio capability or deep vacuum capability up to 28"Hg (15:1 pressure ratio) in this case.

Figure 18A:
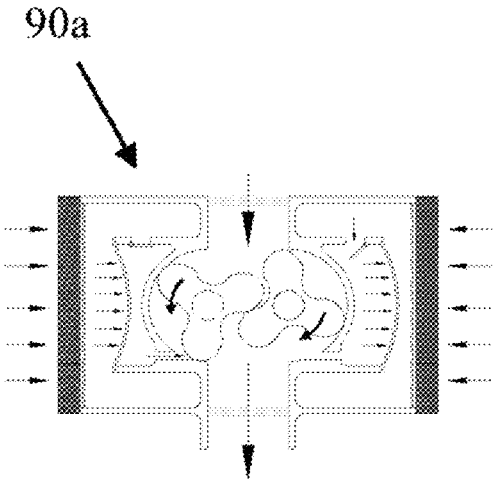
FIGS. 18*a* to 18*c* show cross-sectional side views of yet another alternative embodiment of the shunt pulsation trap with a diaphragm used as a dampener and a supercharger when the pulsation trap outlet (feedback port) is open to atmosphere.
Figure 18B:
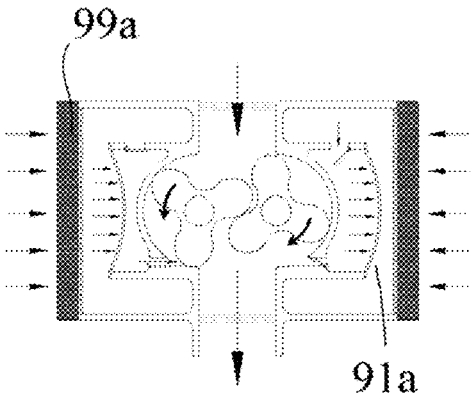
Figure 18C:
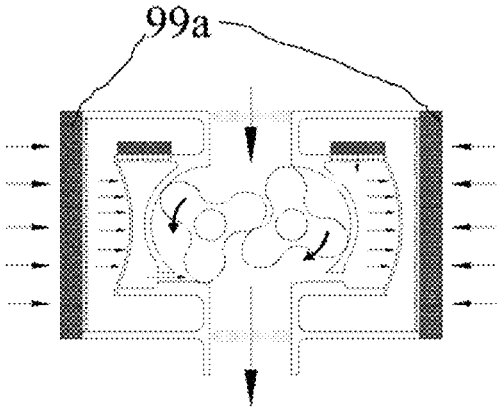

FIGS. 18*a-c* show a typical arrangement of yet another alternative embodiment of the rotary blower 10 with a shunt pulsation trap apparatus 90*a*. In this embodiment, a diaphragm or a piston 91*a* is used as an alternative pulsation dampening device for the pulsation trap 90*a*, to additionally provide for energy recovery (pumping). Moreover, an inlet filter element 99*a* is used as an additional dampener in place of the side inlet 93 shown in FIG. 17. In this embodiment as shown in FIG. 18*b*, the difference with embodiment shown in FIG. 17 is that all or part of the pulsation energy is not lost but absorbed and stored in diaphragm 91*a* during charging phase which later is used to pump air in from atmosphere during the discharging phase in a similar way as described for embodiment shown in FIGS. 12*a-c* and 14*a-c*, or alternatively used to drive an external load during the discharging phase in a similar way as described for embodiment shown in FIGS. 15*a-c*.

Figure 19A:
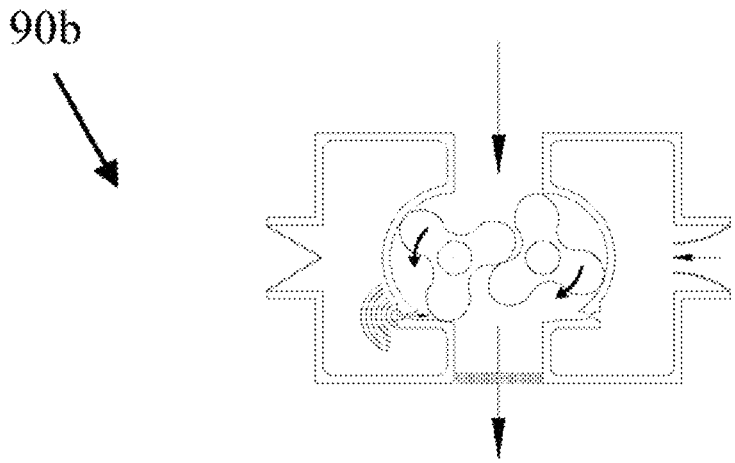
FIGS. 19*a* and 19*b* show cross-sectional side views of yet another alternative embodiment of the shunt pulsation trap with a valve at trap outlet that is open to atmosphere.
Figure 19B:
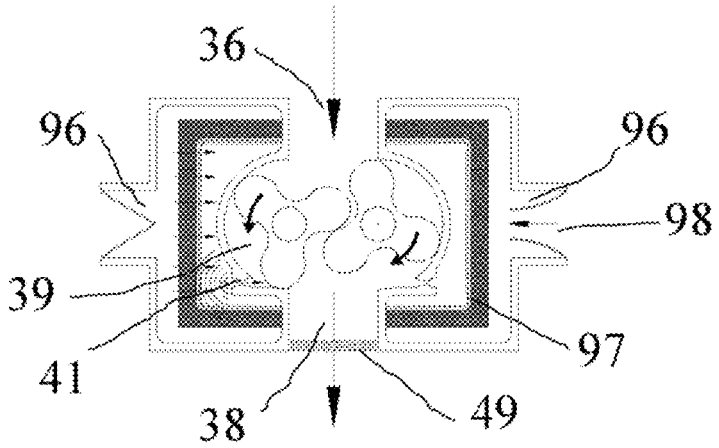

FIGS. 19*a-b* show a typical arrangement of yet another alternative embodiment of the rotary blower 10 with a shunt pulsation trap apparatus 90*b*. In this embodiment, the pulsation trap outlet 98 is a side port and open to atmosphere instead of blower discharge port 38. Like in FIGS. 16*a-b*, a control valve 96 is used as pulsation dampening device for the pulsation trap 90*b*, to additionally provide for pulsation containment. The principle of operation is the same as the embodiment shown in FIG. 16 except that feedback flow comes from atmosphere through port 98. By using a control valve 96 such as a one-way valve or timed valve, it only allows flow in while keeping the waves from going out of the trap to atmosphere.

It is apparent that there has been provided in accordance with the present invention a rotary blower with a shunt pulsation trap for effectively reducing the high pulsations without increasing overall size of the blower. While the present invention has been described in context of the specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A rotary blower, comprising:

a. a housing structure having an inner casing with a flow suction port, a flow discharge port, and a transfer chamber there-between;

b. two parallel multi-lobe rotors having a same number of lobes defining lobe spans and rotatably mounted on two parallel rotor shafts respectively inside said transfer chamber and synchronously driven for propelling flow from said suction port to said discharge port in a flow direction;

c. a shunt pulsation trap apparatus comprising an outer casing oversized and surrounding said inner casing to cooperatively form a pulsation trap chamber therebetween, at least one pulsation dampening device positioned within the pulsation trap chamber, at least one trap inlet branching off from said transfer chamber at least one lobe span away from said flow suction port in said flow direction and connecting said transfer chamber to said pulsation trap so that at least a portion of said transfer chamber and said pulsation trap chamber are arranged in parallel, and at least one trap outlet connecting said pulsation trap chamber to said discharge port;

wherein in operation said rotary blower achieves reduced pulsation and NVH at said pulsation trap chamber and improved blower efficiency.

2. The rotary blower as claimed in claim 1, wherein said rotor lobes have a straight shape perpendicular to said flow direction and have at least two lobes per rotor.

3. The rotary blower as claimed in claim 1, wherein said rotor lobes have a twisted shape perpendicular to said flow direction and have at least three lobes per rotor.

4. The rotary blower as claimed in claim 1, wherein said trap inlet has a converging cross-sectional shape or a converging-diverging cross-sectional shape in a feedback flow direction.

5. The rotary blower as claimed in claim 1, wherein said pulsation dampening device comprises at least one layer of perforated plate.

6. The rotary blower as claimed in claim 1, further comprising at least one synchronized valve that is closed and opened as said each lobe passes said trap inlet.

7. The rotary blower as claimed in claim 1, wherein said pulsation dampening device comprises at least one Helmholtz resonator.

8. The rotary blower as claimed in claim 1, wherein said pulsation dampening device comprises at least one diaphragm or piston in parallel with an opening for absorbing pulsation energy and turning that energy into pumping air from said trap outlet through said opening into said trap inlet, for energy recovery.

9. The rotary blower as claimed in claim 1, wherein said pulsation dampening device comprises at least one diaphragm or piston synchronized with a valve for absorbing pulsation energy and turning that energy into pumping air from said trap outlet through said valve into said trap inlet, for energy recovery.

10. The rotary blower as claimed in claim 1, wherein said pulsation dampening device comprises at least one diaphragm or piston synchronized with a valve for absorbing pulsation energy and directing that energy into driving an externally connected load, for energy recovery.

11. The rotary blower as claimed in claim 1, wherein said pulsation trap further comprises at least one perforated plate located at said discharge port, and either before or after said trap outlet.

12. The rotary blower as claimed in claim 11, wherein said perforated plate has holes with a cross-sectional shape of a converging shape or a converging-diverging shape in a flow direction.

13. The rotary blower as claimed in claim 1, wherein said outer casing is an integral part of said inner casing and is further made from cast materials.

14. The rotary blower as claimed in claim 1, wherein at least two of said pulsation traps are connected in series wherein said first trap inlet is at least one said lobe span away in said flow direction from said suction port and said first trap outlet communicates with said second pulsation trap chamber, and said second trap inlet is at least one said lobe span away in said flow direction from said first trap inlet and said second trap outlet communicates with said outlet port in order to achieve multistage compression and dampening.

15. The rotary blower as claimed in claim 1, wherein said pulsation dampening device comprises at least one control valve located at said trap outlet, for pulsation containment.

16. The rotary blower as claimed in claim 15, wherein said control valve is a reed valve or another one way valve.

17. The rotary blower as claimed in claim 15, wherein said control valve is timed to close and open as each said lobe passes said trap inlet.

18. The rotary blower as claimed in claim 1, wherein said pulsation dampening device comprises at least one dampener for turning pulsation into heat, in series with at least one control valve located at said trap outlet, for pulsation containment.

19. The rotary blower as claimed in claim 1, wherein said pulsation dampening device comprises at least one diaphragm or piston synchronized with a valve for absorbing pulsation energy and turning that energy into pumping air from said trap outlet through said valve into said trap inlet, for energy recovery.

20. A rotary blower, comprising:

a. a housing structure having an inner casing with a flow suction port, a flow discharge port, and a transfer chamber there-between;

b. two parallel multi-lobe rotors having a same number of lobes and rotatably mounted on two parallel rotor shafts respectively inside said transfer chamber and synchronously driven for propelling flow from said suction port to said discharge port in a flow direction; and c. a shunt pulsation trap apparatus comprising an outer casing oversized and surrounding said inner casing to cooperatively form a pulsation trap chamber therebetween, at least one pulsation dampening device, positioned with said a pulsation trap chamber, at least one trap inlet branching off from said transfer chamber at least one lobe span away in said flow direction from said flow suction port and connecting said pulsation trap chamber to said pulsation trap, and at least one trap outlet communicating with ambient atmosphere;

wherein in operation said rotary blower achieves reduced pulsation and NVH at said pulsation trap chamber and improved blower efficiency.

21. The rotary blower as claimed in claim 20, wherein said rotor lobes have a straight shape perpendicular to said flow direction and have at least two lobes per rotor.

22. The rotary blower as claimed in claim 20, wherein said rotor lobes have a twisted shape perpendicular to said flow direction and have at least three lobes per rotor.

23. The rotary blower as claimed in claim 20, wherein said trap inlet has a converging cross-sectional shape or a converging-diverging cross-sectional shape in a feedback flow direction.

24. The rotary blower as claimed in claim 20, wherein said pulsation dampening device comprises at least one layer of perforated plate.

25. The rotary blower as claimed in claim 20, further comprising at least one synchronized valve that is closed and opened as said each lobe passes said trap inlet.

26. The rotary blower as claimed in claim 20, wherein said pulsation dampening device comprises at least one Helmholtz resonator.

27. The rotary blower as claimed in claim 20, wherein said pulsation dampening device comprises at least one diaphragm or piston in parallel with an opening for absorbing pulsation energy and turning that energy into pumping air from said trap outlet through said opening into said trap inlet, for energy recovery.

28. The rotary blower as claimed in claim 20, wherein said pulsation dampening device comprises at least one diaphragm or piston synchronized with a valve for absorbing pulsation energy and directing that energy into driving an externally connected load, for energy recovery.

29. The rotary blower as claimed in claim 20, wherein said pulsation trap further comprises at least one perforated plate located at said discharge port, and either before or after said trap outlet.

30. The rotary blower perforated plate as claimed in claim 29, wherein said perforated plate has holes with a cross-sectional shape of a converging shape or a converging-diverging shape in a flow direction.

31. The rotary blower as claimed in claim 20, wherein said outer casing is an integral part of said inner casing and is further made from cast materials.

32. The rotary blower as claimed in claim 20, wherein at least two of said pulsation traps are connected in series wherein said first trap inlet is at least one lobe span away in said flow direction from said suction port and said first trap outlet communicates with said second pulsation trap chamber, and said second trap inlet is at least one lobe span away in said flow direction from said first trap inlet and said second trap outlet communicates with said atmosphere in order to achieve multistage compression and dampening.

33. The rotary blower as claimed in claim 20, wherein said pulsation dampening device comprises at least one control valve located at said trap outlet, for pulsation containment.

34. The rotary blower as claimed in claim 33, wherein said control valve is a reed valve or another one way valve.

35. The rotary blower as claimed in claim 33, wherein said control valve is timed to close and open as each said lobe passes said trap inlet.

36. The rotary blower as claimed in claim 20, wherein said pulsation dampening device comprises at least one dampener for turning pulsation into heat, in series with at least one control valve located at said trap outlet, for pulsation containment.

37. A rotary blower, comprising:

a. a housing structure having an inner casing with a flow suction port, a flow discharge port, and a transfer chamber there-between;

b. two parallel multi-lobe rotors having a same number of lobes defining lobe spans and rotatably mounted on two parallel rotor shafts respectively inside said transfer chamber and synchronously driven for propelling flow from said suction port to said discharge port in a flow direction;

c. a shunt pulsation trap apparatus comprising an outer casing oversized and surrounding said inner casing to cooperatively form a pulsation trap chamber therebetween, at least one pulsation dampening device positioned within the pulsation trap chamber, at least one trap inlet branching off from said transfer chamber at least one lobe span away from said flow suction port in said flow direction and connecting said transfer chamber to said pulsation trap so that at least a portion of said transfer chamber and said pulsation trap chamber are arranged in parallel, and at least one trap outlet in communication with a discharge pressure;

wherein in operation said rotary blower achieves reduced pulsation and NVH at said pulsation trap chamber and improved blower efficiency.

* * * * *